US005121903A

United States Patent [19]

Ripley et al.

[11] Patent Number: 5,121,903

[45] Date of Patent: Jun. 16, 1992

[54] QUENCHING ARRANGEMENT FOR A FURNACE

[75] Inventors: Fred W. Ripley, Perkasie; David E. Felker, Allentown, both of Pa.

[73] Assignee: Vacuum Furnace Systems Corporation, Souderton, Pa.

[21] Appl. No.: 667,332

[22] Filed: Mar. 11, 1991

[51] Int. Cl.[5] ..... C21D 9/00

[52] U.S. Cl. ..... 266/250; 266/251; 266/259

[58] Field of Search ..... 266/250, 251, 259

[56] References Cited

U.S. PATENT DOCUMENTS

| | | | |
|---|---|---|---|
| 3,301,541 | 1/1967 | Ipsen | 266/250 |
| 4,171,126 | 10/1979 | Zahn et al. | 266/250 |
| 4,195,820 | 4/1980 | Berg | 266/250 |
| 4,462,577 | 7/1984 | Westeren | 266/250 |
| 4,610,435 | 9/1986 | Pfau et al. | 266/250 |
| 4,634,103 | 1/1987 | Schmetz et al. | 266/250 |
| 4,709,904 | 12/1987 | Schmetz et al. | 266/250 |
| 4,860,222 | 1/1975 | Tennenhouse | 266/250 |

*Primary Examiner*—Upendra Roy
*Attorney, Agent, or Firm*—William E. Cleaver

[57] ABSTRACT

The present arrangement provides for having the plenum divided into at least two sections. One section dumps quench gas from a first direction into the hot zone chamber during a first period and the other section dumps quench gas into the hot zone from an opposite direction during a second period whereby the cooling is relatively uniform. During the quenching operation the quenching gas is drawn from the hot zone chamber through a heat exchange and is returned therefrom to a loop through the hot zone chamber in touch with the workpiece. Direction flow gates control the alternate use of the two plenum.

7 Claims, 3 Drawing Sheets

QUENCHING ARRANGEMENT FOR A FURNACE

BACKGROUND OF THE DISCLOSURE

Industrial furnaces, in particular vacuum furnaces, are very often employed to "heat treat" metals. The "heat treating" is involved, for instance, in brazing one metal piece to another. In an another example "heat treating" is involved in hardening a metal by heating a workpiece to a specified temperature, holding the workpiece at that temperature for a specified period of time (which causes the microstructure of the workpiece to change to a desired arrangement), and then "freezing" the microstructure in the desired configuration. The so called "freezing" is accomplished by quenching the workpiece. In many applications, the more rapidly a workpiece is quenched, the better is the desired microstructure. A common example of such hardening would be the heat treatment of tool and die steels, such as ASI grades A, D and H as well as others. In prior art vacuum furnace arrangements, workpieces have been heated in a hot zone, in response to radiation of heat from heating elements located within the vacuum furnace. More particularly, the heating elements are located in the vacuum furnace within a hot zone. Hot zones are very often defined by a chamber made up of heat insulating material, although other arrangements for defining the hot zone are known. The heating elements are energized by electrical energy and as they get progressively hotter they radiate heat, which radiation heat is transmitted across the vacuum condition in the furnace to a workpiece location to heat the workpiece, or workpieces. The foregoing technology has been successful but it does require time. At low radiation temperatures (e.g. 1200° F.) the response time to heat the workpiece is slow. The present arrangement gets the heating process underway more quickly than radiation per se because convection heating is employed at lower temperatures. In the present arrangement, the vacuum chamber is initially pumped down to a vacuum condition. Thereafter, the vacuum furnace is backfilled with an inert gas, such as nitrogen, to near atmospheric pressure. The inert gas is circulated in close proximity to the heating elements, as they heat up. Before the heating elements are in the heated condition to heat a workpiece by radiation heat, they do in fact start heating the inert gas. During the early heating process, the heated inert gas is passed over the workpieces and transfers heat thereto by convection. This early heating step saves time in the overall cycle and saves energy by getting the workpiece to the desired temperature more quickly than by the radiation method per se. When the workpiece has been heated to the desired temperature, which is measured by a thermocouple, or some other device, the workpiece is held at that temperature for a specified amount of time, i.e. until the microstructure of the workpiece is transformed to a desired microstructure.

As was mentioned above, the workpiece must be quenched to "set" the desired microstructure. Heretofore, the method for quenching has been to force a large amount of inert gas into the hot zone from a number of different angles to create turbulence in the hot zone. By creating turbulence in the hot zone, the workpiece comes in contact with many surfaces of many different layers of gas. The layers of gas pass over, and in contact, with the workpiece and in so doing heat is transferred to the quench gas from the workpiece. In short, exposure of the workpiece to multiple surfaces of the quench gas cool the workpiece rapidly. In prior art quenching arrangements, the workpiece has not been cooled as uniformly as desired because of the temperature non-uniformity of the quench gas surfaces passing over the workpiece. The present system improves the quench time and the quench uniformity, by providing many cooled surfaces of inert gas, to be applied to the workpiece. In a preferred embodiment of the present arrangement, the system is structured to divide the plenum (which surrounds the hot zone) into upper and lower plenum chambers, at least first and second plenum chambers. When the quenching step commences, a valve connecting the vacuum furnace housing chamber to one or more surge tanks is opened and inert gas, which is under a relativity high pressure in the surge tanks, surges into the first plenum chamber. The surging "quench gas" rapidly passes into the hot zone to come into contact with the workpiece. Simultaneously therewith, a recirculating turbine fan device draws the inert gas from the hot zone and directs it to the second plenum chamber. Of course, the gas which is being drawn from the hot zone has been in contact with the workpiece and has taken some of the heat from the workpiece and is therefore, itself, heated up. In drawing the previously heated gas from the hot zone, to be loaded into the second plenum chamber, the previously heated gas is directed through a pair of heat exchangers which act to withdraw heat from the previously heated gas. The gas is then passed through the second plenum chamber into the hot zone to come into contact with the workpiece and thereafter is drawn from the hot zone in response to the operation of the recirculating turbine fan. The quenching gas is then passed, alternately, between the first and second plenum chambers, by way of the hot zone and the heat exchangers. Hence the quenching gas repeatedly comes in contact with the workpiece and is cooled by passing through heat exchangers. These repeated cycles provide many relatively cool surfaces of gas layers to the workpiece and have been found to reduce the general quenching time as well as improve the uniformity of the quench of the workpiece.

SUMMARY OF THE DISCLOSURE

The present arrangement involves providing two baffle structures which are located between the outside of the insulating wall of the hot zone and the inside cold wall of the vacuum housing chamber. The baffles are also located to be on opposite sides of the hot zone. Heretofore, in the prior art, there was provided a single separate plenum structure surrounding the hot zone. The outside cold wall was not part of the plenum. With the improved arrangement, the space between the outside wall of the hot zone and the inside cold wall of the vacuum chamber housing is employed as the plenum. The presence of the baffles divides the plenum into a first plenum chamber and a second plenum chamber. In a preferred embodiment the first and second plenum chambers are located at the top and bottom of the hot zone. While in a preferred embodiment, the baffles divide the new plenum into two plenum chambers (top and bottom of hot zone), more such chambers could be created. The purpose of the two baffles is to act, with a pair of flow director devices or gate devices, to alternately pass quenching gas into the hot zone respectively from above and below the hot zone. The use of first and second plenum chambers enables the inert quenching gas to sweep the hot zone first from one direction (with considerable turbulence involved) with some gradients of cooling effect and thereafter, from an opposite direction with some gradients of cooling effect. The gradients of cooling are smoothed out, to provide for overall uniform heat dissipation or cooling. In order to drive the hot zone from opposite directions, the quenching gas is withdrawn from the hot zone by a recirculating turbine fan and simultaneously driven alternately, into the first and second halves of the plenum, i.e. the first and second plenum chambers. In withdrawing the quenching gas from the hot zone, it is passed through first and second heat exchangers to cool the quenching gas before recirculating the quenching gas back into the hot zone. Accordingly, not only does the quenching gas cool the workpiece by turbulence, as in the prior art, but it is recirculated which permits the withdrawal of heat from the quenching gas by the heat exchangers. At the same time the system directs the quenching gas to sweep the hot zone, i.e. the workpiece, from two directions to greatly improve the uniformity of cooling and to reduce the time necessary therefor.

In addition, the present arrangement provides for quicker heating up of the workpiece and the saving of electrical energy. After the vacuum furnace housing has been pumped down to a vacuum condition, it is backfilled to near atmospheric pressure with an inert gas such as nitrogen. Thereafter, the heating elements are electrically energized for the purpose of heating them so that they will radiate heat to the workpiece. A period of time elapses between when the heating elements are initially energized and when they usefully radiate heat to the workpiece. The present arrangement acts during that period of time to heat the inert gas, which has been initially backfilled to atmospheric pressure. The inert gas is recirculated through the hot zone and is heated by convection. The inert gas is carried by conduit means and the conduit means is placed close to the heating elements. The inert gas is in contact with the conduit means and thus gets heated. During recirculation of the heated inert gas (after it leave the conduit) it comes in contact with workpieces. The heated inert gas transfers heat to the workpieces to "preheat" the workpieces prior to the heating elements becoming sufficiently heated to effectively radiate heat to the workpieces. When the heating elements are sufficiently heated to radiate, then the workpieces are being heated by both radiation from the heating elements and by convection from the recirculating inert gas. At some predetermined temperature of the workpiece, the inert gas is pumped out and the workpiece is heated by radiation per se.

BRIEF DESCRIPTION OF THE DRAWINGS

The objects and features of the present invention will be better understood when the description below is considered in conjunction with the drawings, wherein.

DETAILED DESCRIPTION OF A PREFERRED EMBODIMENT

Figure 1:
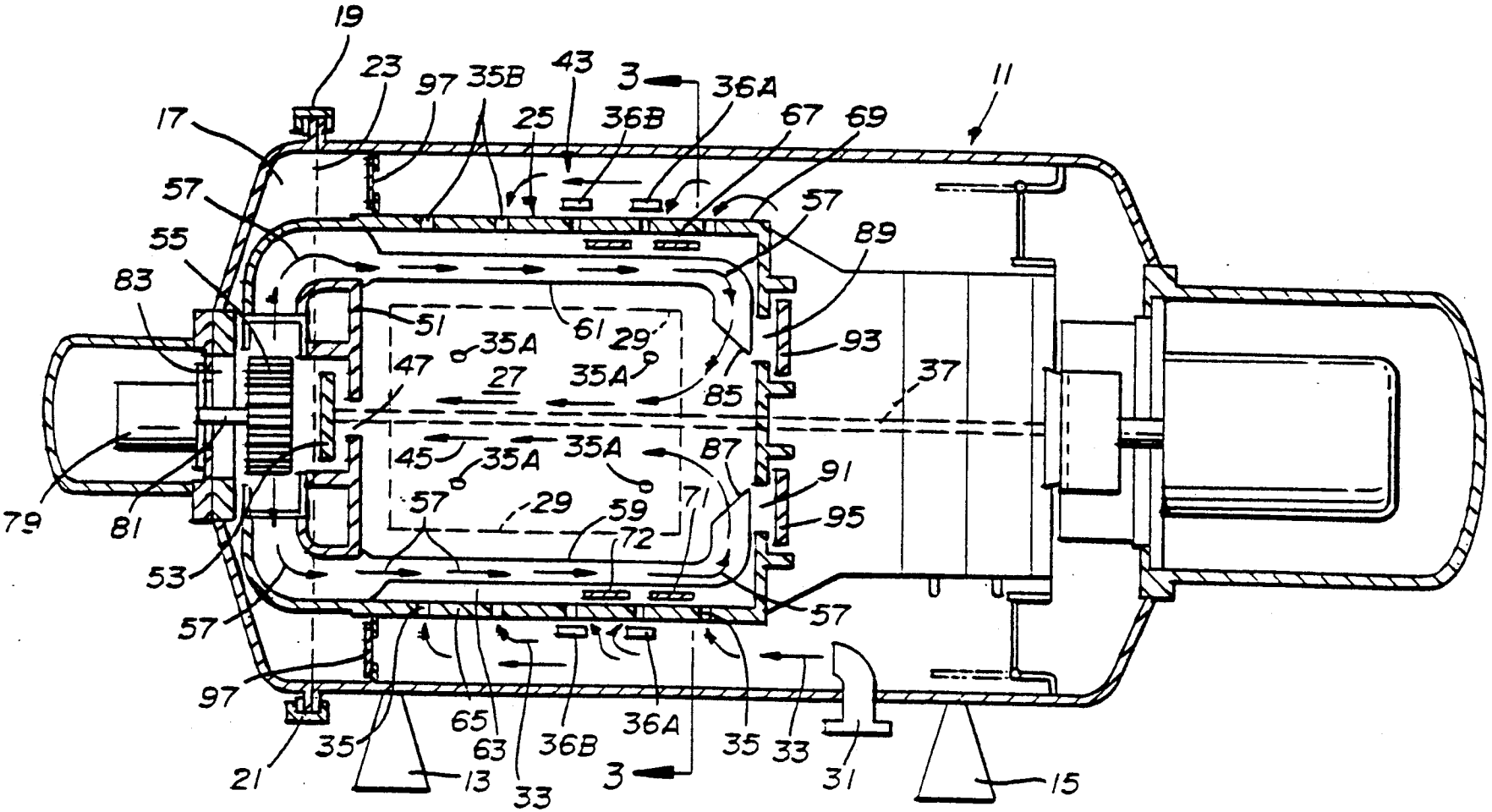
FIG. 1 is a pictorial schematic (with the side of the chamber and hot zone removed) depicting the early heating feature.

Consider FIG. 1 wherein there is shown the vacuum furnace housing chamber 11. The vacuum furnace housing chamber 11 is mounted on two stands 13 and 15 as shown in FIG. 1. Also shown in FIG. 1 is a door 17 on the left-hand side of the furnace housing. The door 17 is secured in position by a number of door locking devices of which 19 and 21 are shown. The edge of the door 17 is depicted by the broken line 23. It should be understood that the door 17 is mounted on hinges (not shown) and would be swung leftward (toward the left of the drawing) on the occasions that it is opened. When the door 17 is open, the user is able to insert workpieces into the hot zone 25 and in particular into the workpiece location 27 which is defined by the dashed line 29.

Figure 2:
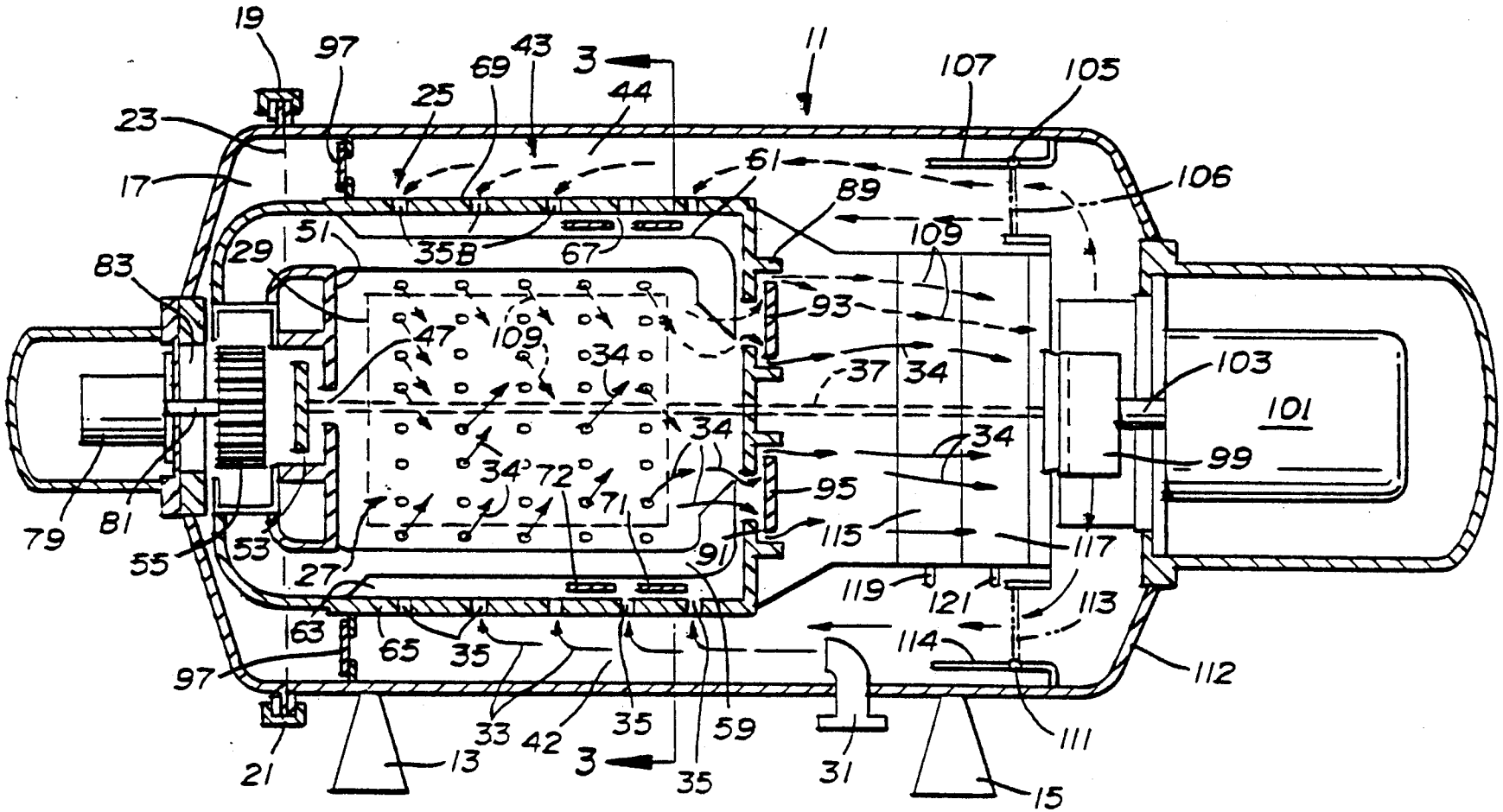
FIG. 2 is pictorial schematic (with the side of the chamber and hot zone removed) depicting the quench feature.
Figure 3:
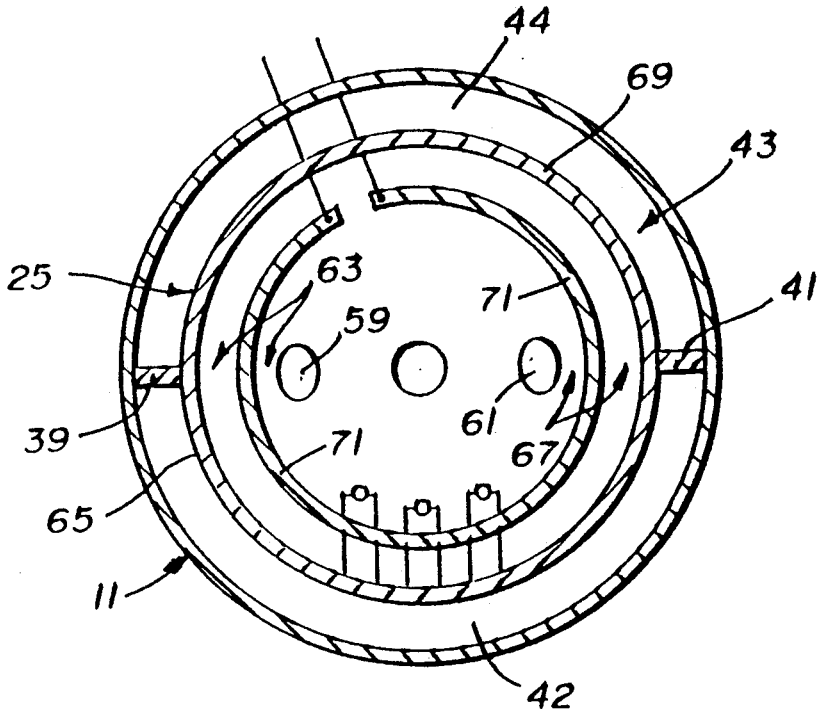
FIG. 3 is a cross-sectional view (along 3—3) of the vacuum furnace without the side of the chamber and hot zone removed, in particular depicting the two plenum chambers and the early heating conduits.

Assume that the system is being early heated. Prior to early heating, the door 17 will be opened and the workpiece or workpieces will be located in the workpiece area 27. Thereafter the door 17 will be closed and the vacuum furnace housing chamber 11 will be pumped down to a vacuum condition of 50 Microns. The pumping down of this chamber into a vacuum condition is accomplished by pumping the air (in the chamber) out through a port not shown. When the system has been pumped down to a vacuum of 50 Microns, then the system is backfilled to near atmospheric pressure by pumping some inert gas, such as nitrogen, into the hot zone 25, through inlet pipe 31, as shown by the arrows 33. As can be recognized by the flow of the arrows 33, the inert gas passes through the nozzles 35 into the hot zone 25. It should be understood that the nozzles in the hot zone are not simply in one row, such as the row of nozzles 35 depicted in the drawing, but actually are located in rows completely around the hot zone chamber (see FIG. 2). The further positioning of some of the nozzles is shown at 35A and 35B and even with respect thereto it should be understood that there are many rows of nozzles located in the wall of the hot zone. As can be gleaned from FIG. 1 there are bands located around the columns of nozzles. Only two of the bands 36A, and 36B are shown, but there is a band for each column of nozzles. The purpose of the bands is to reflect heat back into the hot zone. It should be further understood that there is a baffle located between the wall of the hot zone 25 and the inside cold wall of the vacuum furnace housing chamber 11. Actually there are two baffles employed. The position of one of the last mentioned baffles is shown by the dashed line 37. The baffles can be better appreciated by looking at FIG. 3 and noting the locations of the baffle 39 and the baffle 41. The two baffles 39 and 41, divide the plenum 43 into first and second plenum chambers. Accordingly, when an inert gas, such as nitrogen, is backfilled into the hot zone 25, it can be arranged that the nitrogen can only backfill one of the two plenum chambers at one time. It should be understood that the system can be controlled to backfill both plenums at the same time. Once a plenum chamber is backfilled, the inert gas passes into the hot zone in order to be circulated therethrough and comes in contact with the workpieces that are within the workpiece location 27. The inert gas passes out of the hot zone, as shown by the arrows 45. The inert gases pass through the opening 47, in the wall 51 and around the baffle 53 as shown. The inert gasses are picked up by the recirculating turbine fan 55 and are recirculated as shown by the arrows 57. The gas in this early heating stage is recirculated through two graphite conduits 59 and 61. The conduits 59 and 61 are fabricated from a high temperature material, such as graphite because they come in very close proximity to the heating elements (which are not shown in FIG. 1 but are shown in FIG. 3). On the lower side of FIG. 1, the heating elements lie in the space 63 between the graphite conduit 59 and the hot zone wall 65. On the other side of the hot zone there is a similar space 67 which is located between the hot zone wall 69 and the graphite conduit 61. As mentioned above, the arrangement of the heating elements lying between the conduit and the wall of the hot zone can better be appreciated by looking at FIG. 3.

In FIG. 3 the two graphite conduits 59 and 61 are shown by an end view. In addition, there is depicted in FIG. 3 heating element 71, which lies in the space 63 between the left hand conduit 59 and the section 65 of the hot zone 25. On the other side of FIG. 3 there is shown the heating element 71 which lies in the space 67, between the graphite conduit 61 and the section 69 of the hot zone 25.

Consider FIG. 1 again. In FIG. 1 it is shown that the recirculating turbine fan 55 is coupled to the motor 79 to be driven thereby. The motor 79 is coupled by the shaft 81 to the turbine fan 55 through proper bearing arrangements 83.

At approximately the time that the inert gas is pumped into the hot zone chamber, as described earlier, the heating elements shown in FIG. 3 are electrically energized. The inert gas passes over the heating elements initially and is then drawn through the wall 51, as described earlier, into the path of the recirculating fan 55, and is recirculated as is shown. As the inert gas is recirculated, it passes along the two graphite conduits 59 and 61 which are in close proximity to the heating elements as shown in FIG. 3. Accordingly the inert gas is heated up by convection, i.e. coming in contact with the heated graphite walls of the conduit. The heated inert gas leaves the graphite conduits and is directed through the workpiece area 27 to come in contact with the workpiece. In this way the workpiece is heated up by convection, i.e. from the heated inert gas passing along and in contact with the workpiece. The foregoing procedure continues and in response to the heating elements being heated to a temperature that they start effectively radiating heat to the workpiece. The workpiece becomes heated by both convection and radiation. In other words, the heating elements radiate heat to the workpiece and the workpiece gets heated by both the radiating heat and by the convection heat from the heated inert gasses. At a predetermined temperature of the workpiece, the backfilled inert gas is pumped out and the workpiece is heated by radiation heat per se. When the workpiece gets to the desired temperature to effect the desired microstructure change, as discussed earlier, the temperature of the workpiece is held steady by controlling the electrical energy that heats the heating elements. After the workpiece has been held at the desired temperature, for the desired amount of time, the system is ready to accept a quenching step. Before discussing the quenching step, it should be noted that the graphite conduits 59 and 61 are fabricated so that the extreme corners, respectively corners 85 and 87, are shaped and located such that they block the sections of exits 89 and 91 which lie opposite the conduits. To say it another way, the shapes of the conduits 61 and 59, at the end points 85 and 87, are such that the inert gas which is being recirculated, in fact, does not go out through the exits 89 and 91. If the inert gas escaped through exits 89 and 91, it would result in losing some of the effect of recirculation of gas across the workpiece. It should also be noted that the role of baffle 53 is to prevent heat from passing out through the exit 47 and ultimately creating a cold spot at the section of the workpiece location which lies opposite the exit 47. It should also be noted that on the right hand side (in the drawing) of the hot zone, the baffles 93 and 95 play the same role as the baffle 53. In other words the baffles 93 and 95 reflect heat back into the hot zone chamber so that cold spots do not develop opposite the exits 89 and 91. It should also be understood that the wall 97 completely encircles the hot zone 25 to provide the back end of the plenum 43. As was mentioned earlier, plenum 43 is actually divided into two plenum chambers 42 and 44, as can be better appreciated from FIG. 3.

Consider now that the workpiece has been raised to its proper temperature and it has been held at the proper temperature for the proper amount of time and now the system wants to effect a fast quench. In order for the system to effect a fast quench, the system employs one, or more, large surge tanks (not shown) which are filled with nitrogen, or some other inert gas. The pressure of the inert gas in the surge tanks approximates Twelve Bar and after the inert gas is loaded into the vacuum furnace housing 11, its pressure is approximately Five Bar. Other pressure relationships could be used but, in the preferred embodiment, the described furnace system is a Five Bar system. See FIG. 2. To effect the fast quench a valve between the surge tanks and the inlet pipe 31 is opened and the inert gas surges through the inlet pipe 31 into the hot zone, as depicted by the flow arrows 33. Prior to opening the surge valve, (or the valve to the surge tanks), or simultaneously therewith, the recirculating turbine fan 99 is turned on, or driven, by the fan motor 101. The recirculating turbine fan 99 is shaft coupled to the fan motor 101 by the shaft 103. With the recirculating fan 99 in operation, and the surge tank valve open, the inert gas passes through the nozzles 35, as well as through the many un-numbered nozzles shown as being in the outside wall of the hot zone. The quench gas passes through the foregoing mentioned nozzles into the hot zone, into contact with the workpiece and out of the exits 89 and 91. In FIG. 2, the solid line arrows are meant to depict the quench gas activity in the first half of the quench cycle, while the dashed line arrows are shown to depict the quench gas activity in the second half of the quench step. In other words, initially the first plenum chamber 42, in FIG. 3, is rapidly filled with quench gas and the gas is passed through nozzles (not shown in FIG. 3) in the wall section 65, while during the second half, the second plenum chamber 44 is rapidly filled with quench gas and the gas is passed through the nozzles (not shown) in the wall section 69. During the first half of the quench cycle, the inert gas flows from the many nozzle locations, over the workpiece, through the exits 91 and 89, around the baffles 95 and 93, and on toward the recirculation turbine fan as shown by the arrows 34. When the gases enter the receiving chamber, in which the recirculating turbine fan is located, these gases will be shunted upward, in the drawing, (upward as viewed in FIG. 3) and the flow director device or gate 105 will be in the open position, i.e. in the position shown at 107. The foregoing flow director position will permit the gases, shown by the dashed line, to pass along the second plenum chamber 44, through the nozzles 35B (and the additional nozzles shown on the outside wall of the hot zone chamber) to appear as the dashed lines 109. At the same time, the gate 111 is closed, i.e. in the position shown at 113. The alternate opening and closing of the gates prevents gases, driven by the turbine fan, from being circulated in an undesired direction. As was described earlier, the inert gas (which enters the vacuum furnace housing chamber 11 through the pipe 31), is under very high pressure and it passes through the nozzles into the hot zone chamber creating a great deal of turbulence. These gases, of course, come in contact with the workpiece and reduce the temperature thereof. Simultaneously, the quench gases are drawn by the recirculating turbine fan 99, out of the right hand end (of FIG. 2), i.e. out of the hot zone chamber, around the baffles 93 and 95, and through the heat exchangers 115 and 117. The heat exchanger 115 in the preferred embodiment, is fabricated from stainless steel while the heat exchanger 117 is fabricated from copper. The reason for the difference in fabrication of the two exchangers is that the stainless steel of the heat exchanger 115 can withstand the initial high temperatures which are present during the quench cycle. At the first heat exchanger, the transfer of heat from the quenching gas will reduce the temperature of the quenching gas to a point where those gases will not do damage to the copper fabrication of the heat exchanger 117. On the other hand, copper is a better heat conductor, or better heat sink than stainless steel, and will play the role of reducing the temperature to a greater degree than the temperature is reduced in the heat exchanger 115. It will be noted in FIG. 2 that the heat exchangers have respectively two pipes 119 and 121 connected thereto. These pipes act to provide water to the heat exchangers so that the heat exchangers are water cooled. As the recirculating inert gas passes through the heat exchangers, it is cooled and urged, as mentioned before, in the upward direction, (upward in FIG. 3). Thereafter, in the process of recirculating, the quench gas passes through the nozzles 35B to pass over the workpiece and therefore further reduce the temperature of the workpiece. After having reduced the temperature of the workpiece the inert gas passes through the heat exchangers back to the recirculating turbine fan 99 and thereafter, to the downward side of the drawing. This third step of the excursion would be into the plenum 42 as seen in FIG. 3. The gate 111 would not be closed but would be held in its open position, that is the position shown at 114. In the meantime, the gate 105 would be closed and would be in the position shown at 106. Prior to the third quench step the inert gas would have been cooled twice by the heat exchangers and would have had two occasions to transfer heat from the workpiece. In the third quench step the twice "cooled" gas proceeds through the nozzles 35 (and the other nozzles not numbered), into the lower half, as viewed in FIG. 2, or into the lower half as viewed in FIG. 3, of the hot zone. In the third quench step the "cooled" gas once again comes in contact with the workpiece to further reduce the temperature of the workpiece. This procedure of alternate cooling acts to provide uniformity to the quenching process. It will be noted that, even though the gases are backfilled into the lower side, (FIG. 3) of the hot zone, because they are contained by the baffles 39 and 41, they pass over into the upper half, when they are inside the hot zone. While the quench gases were prohibited from passing into the upper half (the second plenum chamber 44, FIG. 3) from the outside they are drawn upward in FIG. 2. The foregoing is shown by, in particular, the solid line arrows which are located above location 37 of the baffle and are numbered for purposes of identification as 34. The reverse is true during alternate halves of the quench procedure, i.e. quench gases entering the second plenum chamber 44 cross over the middle of the hot zone to exit from exit 91. In accordance with the flow of the inert gases in this quenching procedure, the workpiece is quickly reduced in temperature because of the constant exposure of the workpiece to different (and relatively cool) layers of the quenching gas. In addition, the fact that the quenching gas is fed alternately into each half of the hot zone, there is more uniformity in the quenching operation than has been heretofore experienced in the prior art. The present arrangement takes advantage of the turbulence, which initially exists in the hot zone and further takes advantage of the idea that if the quenching gas is recirculated one half at a time, there are a number of changes of the layers of gas coming in contact with the workpiece and that leads to the rapid reduction of the temperature. By way of particular example, it has been found that the time to reduce the temperature from its desired hot temperature value, to its desired cool value, is greatly reduced when the foregoing technique is employed.

In FIG. 2 it can be noted that the vacuum furnace housing chamber 11 has a hollowed out section 112 and that is included in the drawing to show that the chamber per se is water cooled. When the quenching operation has finished, the door 17 is opened and the inert gas passes out of the vacuum furnace.

What is claimed is:

1. In a vacuum furnace, which has chamber housing means, with a hollow chamber formed therein, and which vacuum furnace has: (1) insulating wall means, having inside wall means and outside wall means, formed and disposed within said hollow chamber to define plenum means between said outside wall means and said chamber housing means, said insulating wall means, further formed and disposed to define, by said inside wall means, hot zone chamber means about an axis therethrough, and having first and second axial ends; (2) a plurality of heating elements formed and disposed within said hot zone chamber means to provide heat to workpiece means located within said hot zone chamber means, gas flows means to effect a relatively fast quench of workpiece means, comprising in combination:

a plurality of gas nozzles means each formed with a cross-section value and an axis which lies relatively orthozonal to said axis of said hot zone chamber and disposed to provide passageways, for gases, through said insulating wall means;

quenching gas exit aperture means formed to have a cross-section value many times larger than said cross-section value of said nozzles and formed at said first axial end of said hot zone chamber;

baffle means formed and disposed within said plenum means to provide at least first and second plenum chambers, with said at least first and second plenum chambers, respectively, having at least first and second groups of said nozzle means opening therefrom;

quench gas receiving means disposed within said hollow chamber of said chamber housing means, formed and further disposed at said quenching gas exit aperture means to receive quench gas therefrom;

quench gas transfer means, formed and disposed in said quench gas receiving chamber means, to transfer quench gas from said hot zone chamber means to said at least first and second plenum chambers;

at least first and second gate means disposed within said hollow chamber of said chamber housing means, formed and disposed to operate alternately with said quench gas transfer means, to selectively and alternately transfer quench gas respectively into said first and second plenum chambers, whereby said quench gas passes alternately through said first and second groups of said nozzle means to come into contact with workpiece means located in said hot zone chamber means, thereby cooling said workpiece means in response to quench gasses coming from said first plenum chamber during one period of time and alternately in response to quench gas coming from said second plenum chamber during a second period of time.

2. In a vacuum furnace, gas flow means according to claim 1 wherein there is further included heat exchanger means located within said hollow chamber in said quench gas receiving means at said first axial end of said hot zone chamber means to extract heat from quench gas passing therethrough and with said heat exchanger means formed to have first and second sections with said first section formed to withstand higher temperatures than said second section.

3. In a vacuum furnace, gas flow means according to claim 1 wherein there is further included heat reflecting means disposed in close proximity to said first axial end of said hot zone chamber means whereby heat directed through said quenching gas exit aperture means is reflected back into said hot zone chamber;

4. In a vacuum furnace, gas flow means according to claim 1 wherein said quench gas transfer means includes a turbine fan means which is designed to draw quench gas from said hot zone chamber means and direct said last mentioned quench gas toward said first and second plenum means.

5. In a vacuum furnace, gas flow means according to claim 1 wherein there is further included heat reflecting bands disposed with respect to said gas nozzle means whereby heat directed through said gas nozzle means from said hot zone chamber means is reflected back into said hot zone chamber means.

6. In a vacuum furnace, gas flow means according to claim 1 wherein there is further included recirculating gas means located at said second axial end of said hot zone chamber means.

7. In a vacuum furnace, gas flow means according to claim 6 wherein said recirculating gas means includes fan means and conduit means with said conduit means disposed to direct gas, exiting from said second axial end, toward said first axial end to effect recirculation of said gas through said hot zone chamber whereby workpiece means are heated by heat residing in said gas being recirculated.

* * * * *